US006286433B1

(12) United States Patent
Borg et al.

(10) Patent No.: US 6,286,433 B1
(45) **Date of Patent: *Sep. 11, 2001**

(54) SMALL CALIBER SHELL

(75) Inventors: Gunnar Borg, Mölltorp; Nils-Olof Karlsson, Karlsborg, both of (SE)

(73) Assignee: Vanasverken AB, Karlsborg (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/171,099

(22) PCT Filed: Apr. 11, 1997

(86) PCT No.: PCT/SE97/00608

§ 371 Date: Jan. 26, 1999

§ 102(e) Date: Jan. 26, 1999

(87) PCT Pub. No.: WO97/41404

PCT Pub. Date: Nov. 6, 1997

(30) Foreign Application Priority Data

Apr. 26, 1996 (SE) ..... 9601590

(51) Int. Cl.[7] ..... F42B 12/06
(52) U.S. Cl. ..... 102/518; 102/516
(58) Field of Search ..... 102/501, 514–519, 102/506, 513

(56) References Cited

U.S. PATENT DOCUMENTS

| | | | | |
|---|---|---|---|---|
| 3,782,287 | * | 1/1974 | Sie | 102/518 |
| 4,625,650 | * | 12/1986 | Bilsbury | 102/516 |
| 5,020,439 | * | 6/1991 | Winter et al. | 102/518 |
| 5,069,139 | | 12/1991 | Denis | 102/518 |

FOREIGN PATENT DOCUMENTS

| | | | | |
|---|---|---|---|---|
| 308457 | * | 1/1920 | (DE) | 102/517 |
| 327539 C | | 10/1920 | (DE) . | |
| 3209594A | | 9/1983 | (DE) . | |
| 826922 A | | 4/1938 | (FR) . | |
| 601686 | * | 5/1948 | (GB) | 102/514 |
| 74530 | * | 1/1949 | (NO) | 102/517 |
| 114382 | * | 6/1945 | (SE) | 102/501 |

OTHER PUBLICATIONS

Derwent's Abstract, No. 95–153611/20, week 9520, Abstract of SU, 1838650–A3 (Barnaul Tool Wks), 1993.

* cited by examiner

*Primary Examiner*—Harold J. Tudor
(74) *Attorney, Agent, or Firm*—Connolly Bove Lodge & Hutz

(57) ABSTRACT

A small caliber shell having armor piercing capacity and extremely high precision. The shell includes a hollow metal shell casing defining an outer shape of the shell. The shell casing has a conical front tip and a rear end, the shell casing comprising an inner surface. An elongate shell core made of an extremely hard and heavy material is centered around a longitudinal axis of the shell between a first bearing surface on the inner surface in the conical front tip of the shell casing and a second bearing surface on the inner surface of the rear of the shell casing and is axially centered inside the shell casing. A support part is arranged inside the shell casing and surrounds at least a very rearmost portion of the shell core for supporting the shell core. A ballast material in the shell casing between the support part and an interior wall of the shell casing holds the support part in place.

13 Claims, 2 Drawing Sheets

SMALL CALIBER SHELL

FIELD OF THE INVENTION

The present invention relates to a new improved small-caliber shell with a certain armor-piercing capacity. The shell according to the invention is of the basic type which includes an outer casing made of a thinner metal material such as tombac, tombac-plated sheet steel or the like, which defines the outer shape of the shell, and a shell core enclosed therein and made of extremely hard armor-piercing material such as hard metal, heavy metal or equivalent.

BACKGROUND OF THE INVENTION

Even though the designation small-caliber can be somewhat vague, it is weapon calibers under 20 mm which are refered to here and then chiefly calibers up to and including 50 caliber which are now, of course, also found in modern handheld firearms chiefly intended for sniping at extremely long ranges. In the case of weapon calibers of 20 mm and above, it would probably be more efficient to use so-called dart shells or other more expensive and more effective shell types for combating armored targets than the simpler and cheaper- type of which the present invention is an example.

Previously known so-called armor-piercing small-caliber shells have very generally consisted of an outer casing made of a relatively thin sheet material which in most cases consisted of tombac, tombac-plated sheet steel or equivalent and a core enclosed therein made of an extremely hard material which often consists of hard metal which is actually not a metal or metal alloy but rather various types of metal carbides and mostly tungsten carbides, or heavy metal which in most cases is tungsten alloys.

As a rule, the armor-piercing core in previous types of armor-piercing small-caliber shells was shorter than and sometimes also of smaller caliber than the inside of the casing. The shells therefore as a rule also contained various types of filling material in order to fill out the interior of the casing and hold the armor-piercing core in place until the shell reached its target.

The armor-piercing capacity of the armor-piercing small-caliber shells is or course clearly limited but, as the use of anti-splinter armors has increased to a very great extent in recent years and as the armor-piercing small-caliber ammunition can under favorable circumstances deal with targets of this type, the need for this type of ammunition can be expected to continue to increase. Clearly, the greatest problem with the current generation of armor-piercing small-caliber ammunition, however, is that, quite generally, it has great differences in the ballistic characteristics of the shells as compared to corresponding standard ammunition of the same caliber. As a result precision shooting with mixed ammunition or rapid changing between different ammunition types is made considerably more difficult.

SUMMARY OF THE INVENTION

The aim of the present invention is to offer a new type of small-caliber shell with a certain very good, with regard to its own caliber-armor-piercing effect. Probably, the greatest advantage of the present invention, with such an inner construction is that its ballistic data can easily be adapted to be very close to or even be made completely identical with the majority of standard ammunition types with the caliber range concerned. Shells designed in accordance with the invention moreover have such good and uniform precision that they fall into the same class as the so-called sniper or special ammunition for marksmen.

In summary, the present invention thus relates to a small-caliber shell with a certain armor-piercing capacity of the type which comprises an elongate, preferably solid shell core or penetrator which is axially centered inside a hollow shell casing and which has a cylindrical main part and a tip which tapers conically forwards in the intended flight direction of the shell in one or more stages. The tip of the shell core itself can thus have the shape of one or more successive frustoconical parts of ever greater apex angles and a concluding conical part, or alternatively, a single conical tip. The outer shape of the shell on the other hand is defined entirely by the shell casing and is therefore designed from the outset with the conical tip which is appropriate for each specific shell type.

The invention is characterized in the first place in that the shell cores or penetrators are centered around the longitudinal axis of the shell casing, that is of the future finished shell, between a first accurate bearing or support against the inside of the shell casing in the front conically pointed part of the shell and a second bearing in the rear part of the shell by means of a support part or insert which is arranged inside the casing and contains at least the very rearmost part of the shell core and which in turn is held in place in the casing by a ballast material which completely fills the rearmost part of the casing.

The bearing, between the inside of the shell core and the front part of the penetrator, takes place either along one of the frustoconical parts of the shell core tip or along the transition or interruption edge between two parts which may be constituted by the cylindrical part of the shell core and its single-coned tip, or alternatively, by different parts of the coned tip. The edge(s) which form(s) the transition between the tip and the cylindrical part, or alternatively, between different parts of the tip coned in a number of stages is then a natural circumferential bearing line for centering the front part of the penetrator against the inside of the casing well into the part of the same which forms the tip of the shell, providing of course that the penetrator has a smaller diameter than the inside of the shell casing and also a more obtuse apex angle on its own tip than the inner apex angle of the casing.

The possibility of locating the bearing of the shell core against the inside of the casing along an entire frustoconical surface is selected in particular when there is a need for the greater friction contact surface, which is then obtained, in order to ensure that the shell core does not have a tendency to remain still inside the rotationally stabilized casing, that is in ammunition types with extremely high speed of rotation. With this variant, the possibility exists to increase the contact surface between the shell core and the inside of the shell casing to correspond in principle to more than half the tip length of the shell core.

The advantages with the four-part basic construction indicated above are numerous. Firstly, the armor-piercing shell core is very well supported and centered in the shell casing right up to the moment that the shell reaches the target. Secondly, the ballistic data of the shell can easily be modified by adjusting the ratio between the weight of the ballast material and of the support part respectively. This can be done both by varying the material selected in the different parts and by varying their mutual volume ratios. At the same time, the same armor-piercing shell core can be used in a number of different adjacent calibers, of which there is a large number intended mainly for lighter handheld firearms and this will mean considerable cost savings. The support part or insert can be made of any material with sufficiently good strength and moldability. Steel or aluminium, for example, are good materials but the possibility of using certain plastics for this purpose is not inconceivable. The ballast material filling the rearmost part of the casing is required to be plastically deformable so that it can be given the desired final shape while permitting the rearmost part of the shell to be finally shaped in a known manner including folding-in at the rear of the rear outer edge of the casing at the same time as possibly equipping with a so-called boat tail end by upsetting. It is very important that an absolutely gastight connection is obtained between the inside of the casing and the ballast material. Excellent materials for this purpose are lead and various lead alloys.

For the shell according to the invention, the armor-piercing core or penetrator can advantageously be given -the shape of an elongate cylinder The tip of the shell tapers conically in one or more stages. Also, the shell has a frustoconical rear end. This frustoconical end provides an excellent support for the part of the penetrator which the support part or insert overlaps, that is, the part of the penetrator which is inserted into the insert.

As the contact line between the penetrator and the inside of the casing is to lie in the part of the casing which forms the tip of the finished shell and the penetrator must therefore have a diameter which is at least slightly smaller than the maximum internal dimension of the casing, there will be in many shell calibers an accessible space between the inside of the shell casing and the penetrator to allow the support part or insert to continue at least some way along the cylindrical part of the penetrator. As the shell casing as a rule has a softer shape than the shell core, a thin tubular first empty space is formed immediately in front of the support part and a second empty space is formed at the very front inside the shell tip.

BRIEF DESCRIPTION OF THE DRAWINGS

The invention will now be described in somewhat greater detail with reference to attached drawings, in which.

DETAILED DESCRIPTION OF THE INVENTION

The two figures show shells with slightly different outer shapes. However, the major difference resides in the fact that the shell cores included in the respective shells are of different types. The shell according to FIG. 1 has a shell core with a single-coned tip while the shell according to FIG. 2 has a tip coned in a number of stages.

Figure 1:
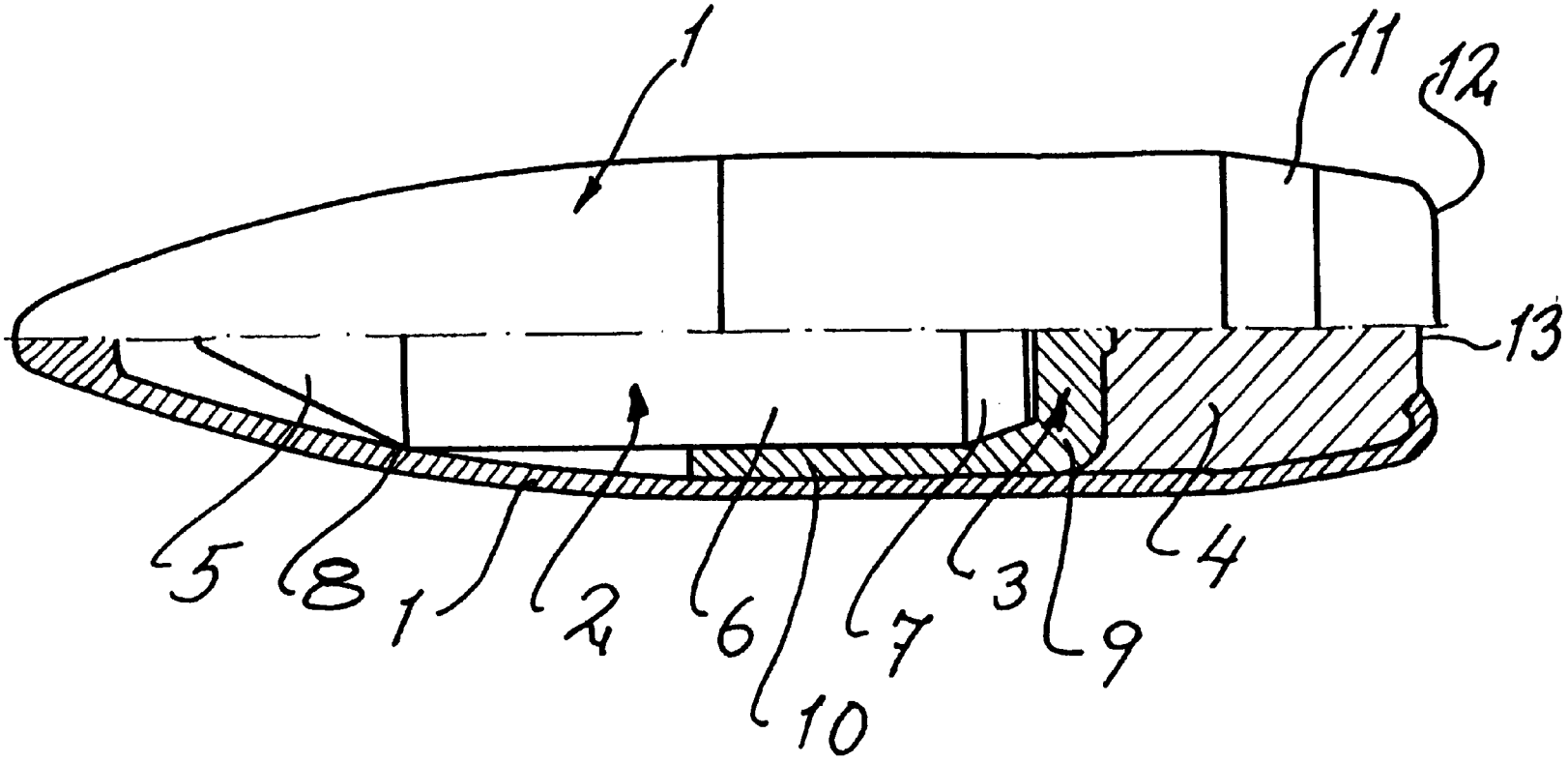
FIGS. 1 and 2 show two different partly cut-away longitudinal projections of shells made in accordance with the invention.

The shell shown in FIG. 1 consists of an outer shell casing 1 made of, for example, tombac or tombac-plated sheet steel, and the inner shell core or penetrator 2 which is made of hard metal, heavy metal or another equivalent material. Also included is a support part or insert 3 which can, for example, be made of aluminium, steel or another suitable material. Finally, the ballast material, designated 4, is included, which fills the rearmost part of the shell casing and in the example shown consists of a lead alloy containing 1–10% antimony.

As can be seen from the figure, it is the shell casing 1 which defines the outer shape of the shell while the shell core or penetrator 2 has a considerably simpler shape with a single conical tip 5, an elongate cylindrical main part 6 and a short frustoconical rear part 7. The peripheral edge line 8 which forms the transition between the conical tip 5 of the penetrator and its cylindrical part 6 also forms, as can be seen from the figure, the bearing edge against the front pointed inside of the casing which gives the penetrator its front support. The portion 9 of the support part or insert 3 that overlaps the frustoconical rear part 7 of the penetrator that is responsible for the rear support of the penetrator 2. This is true even though the neck 10 of the support part 3, extends forward along the cylindrical part 6 of the penetrator, which is allowed by the clearance between the latter and the inside of the casing 1. As can be seen from the figure, the rear part of the shell casing is angled in to form a so-called boat tail 11. At the same time as a final step the rear edge 12 of the casing has also been turned in towards the rear plane 13 of the shell. By then working the lead ballast material plastically to its final shape, a good gastight seal is obtained between the ballast material and the inside of the shell.

Generally, the shell is manufactured such that the front pointed part of the shell casing 1 is preformed to the final dimensions on the other hand, the rear part is only pre-formed. Subsequently the finished penetrator 2 and the support part 3 are guided into places followed by the preformed ballast parts 4. At this point, the middle and rear parts of the shell are given their final shape and dimensions.

Figure 2:
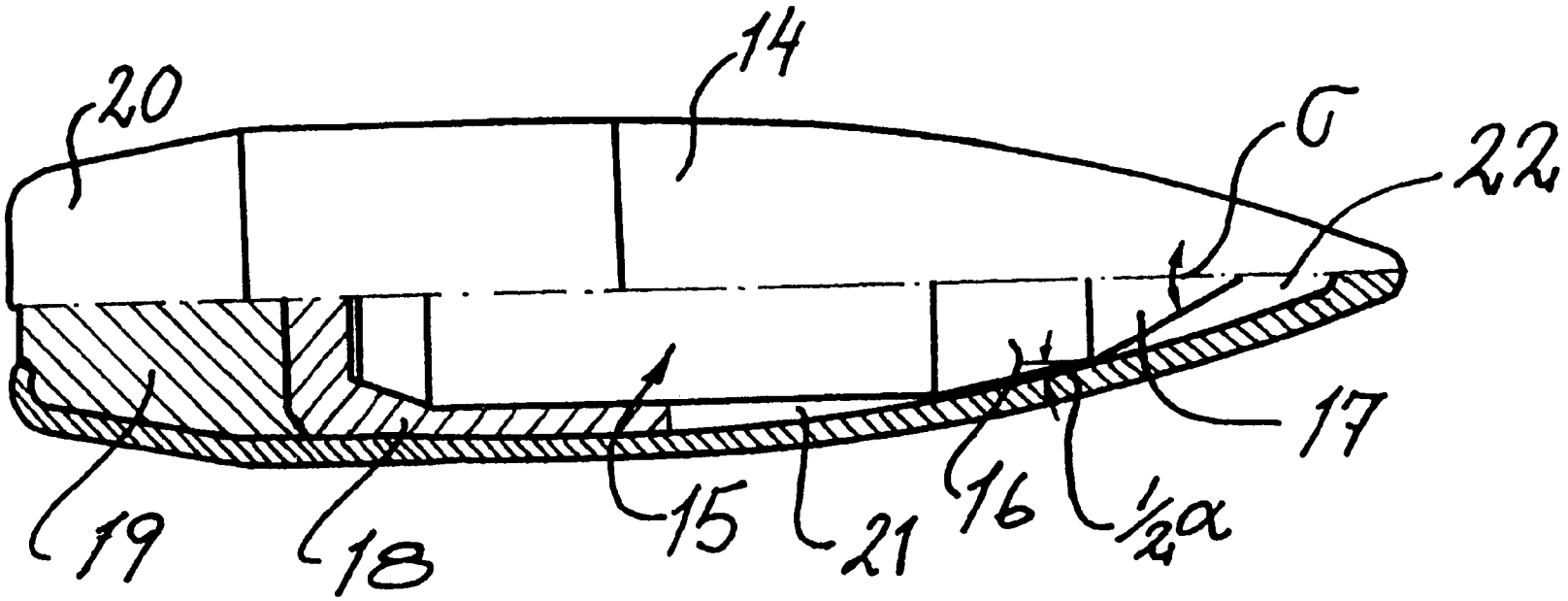

The shell shown in FIG. 2 is produced in a manner corresponding to that in FIG. 1 and, in principle, from the same materials. In this case, however, the casing 14 has a somewhat different shape but above all the shell core 15 is made with a double-coned tip. The first part of the core consists of a frustoconical part 16 with a given first apex angle $\alpha$ and the second part 17 of which consists of a completely conical part with a substantially greater apex angle $\sigma$. The shell tip thus has a double-interrupted side edge line. Other tip constructions, which include a number of frustoconical parts following one another with successively greater apex angles, also fall within the same basic construction. Also included in the shell illustrated in FIG. 2 is the support part 18 which has the same basic construction as the support part 3 in FIG. 1. Also included is a ballast part 19 consisting of lead alloyed with antimony. The end of the shell has been formed with a pronounced boat tail 20 in the same manner as the corresponding detail in FIG. 1. As can clearly be seen from FIG. 2, the contact between the front part of the shell core 15 and the inside of the shell casing 14 is transferred completely to the frustoconical part 16 of the former. As was pointed out earlier, this represents a construction alternative because the friction surface between the tip part 16 of the shell core and the inside of the shell casing becomes so great that it is possible to transfer great frictional forces between these two shell parts.

As in the alternative according to FIG. 1, two empty spaces 21 and 22 are formed inside the shell casing which are not filled by the shell core 15, the support part 18 or the ballast part 19. By virtue of the fact that the shell core is so well supported inside the shell casing, however, this does not represent a disadvantage but rather an advantage which increases the possibilities of adapting the shell according to the invention to the ballistic data concerned in each individual case. The shell according to the invention therefore comprises the six different components, the shell casing, the shell core, the support part, the ballast material and also the first and second empty spaces, the differing size, shape and axial displacement of which can be varied in order to impart the desired ballistic data to the finished shell. To a certain extent, the selection of material in the different parts, with the exception, of course, of the empty spaces, can also be varied within the limits applying for the function of the various parts.

What is claimed is:

1. A small caliber shell having armor piercing capacity and extremely high precision, comprising:

a hollow metal shell casing defining an outer shape of the shell, the shell casing having a substantially conical front tip and a rear end, the shell casing comprising an inner surface;

an elongated shell core made of an armor-piercing material, the shell core being centered around a longitudinal axis of the shell between a first support surface on the inner surface in the conical front tip of the shell casing and a second support surface on the inner surface of a rear portion of the shell casing and being axially centered inside the shell casing; and a ballistic modulating means for varying the ballistic characteristics of the shell comprising a lead or lead alloy ballast material and a monolithic support part, wherein, the relative proportions, both in volume and mass, of the ballast material and support part determine the ballistic characteristics of the shell, the monolithic support part is arranged inside the shell casing and circumferentially surrounds at least a very rearmost portion of the shell core and covers at least a portion of a rear surface of the shell core for supporting and centering the shell core, the support part being arranged between the shell core and the second support surface, and the ballast material is arranged in the shell casing between the support part and an interior wall of the shell casing for holding the support part in place.

2. The small caliber shell according to claim 1, wherein the first support surface is arcuate.

3. The small caliber shell according to claim 1, wherein the shell core comprises a cylindrical main part, a conical front tip and an edge transition between the cylindrical main part and the conical tip, wherein the edge transition engages the first support surface of the shell casing.

4. The small caliber shell according to claim 1, wherein the shell core comprises a main part including a cylindrically-shaped bar and a tip that tapers in at least two stages in a direction of flight of the shell, each stage having a frustoconical shape except a last stage that includes the tip which has a conical form, the stages having apex angles that increase in the direction of flight of the shell.

5. The small caliber shell according to claim 1, wherein an end of the shell core opposite the tip has a shape of a truncated cone and the support part overlaps at least the truncated cone.

6. The small caliber shell according to claim 1, wherein the shell core has a smaller caliber than a greatest internal diameter of the shell casing, and the support part completely fills a space between at least the rearmost portion of the shell core and the inner surface of the shell casing.

7. The small caliber shell according to claim 1, wherein the support part extends along a side of the shell core such that an empty space exists between the support part and the first support surface.

8. The small caliber shell according to claim 1, wherein the ballast material completely fills a rearmost part of the shell casing.

9. The small caliber shell according to claim 8, wherein the ballast material is plastically deformable to provide a good fit and gas tightness between the support part and the inner surface of the shell casing.

10. The small caliber shell according to claim 9, wherein the rearmost part of the shell casing has a boat tail shape.

11. The small caliber shell according to claim 1, wherein the ballast material is plastically deformable to provide a good fit and gas tightness between the support part and the inner surface of the shell casing.

12. The small caliber shell according to claim 1, wherein the rearmost part of the shell casing has a boat tail shape.

13. The small caliber shell according to claim 1, wherein the shell core is solid.

* * * * *